US010805739B2

(12) United States Patent
Sjursen

(10) Patent No.: US 10,805,739 B2
(45) Date of Patent: Oct. 13, 2020

(54) NON-OCCLUDING FEEDBACK-RESISTANT HEARING DEVICE

(71) Applicant: Bose Corporation, Framingham, MA (US)

(72) Inventor: Walter Paul Sjursen, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/878,193

(22) Filed: Jan. 23, 2018

(65) Prior Publication Data

US 2019/0230448 A1 Jul. 25, 2019

(51) Int. Cl.
*H04R 25/00* (2006.01)
*H04R 19/04* (2006.01)

(52) U.S. Cl.
CPC ..... *H04R 25/405* (2013.01); *H04R 25/453* (2013.01); *H04R 25/456* (2013.01); *H04R 25/505* (2013.01); *H04R 25/604* (2013.01); *H04R 19/04* (2013.01); *H04R 2201/003* (2013.01); *H04R 2460/05* (2013.01); *H04R 2460/11* (2013.01)

(58) Field of Classification Search
CPC .... H04R 25/60; H04R 25/65; H04R 2225/49; H04R 2460/01; H04R 2225/023; H04R 2225/025
USPC ..... 381/318, 322, 328
See application file for complete search history.

(56) References Cited

U.S. PATENT DOCUMENTS 5,033,090 A * 7/1991 Weinrich ..... H04R 25/453 381/318
6,353,671 B1 * 3/2002 Kandel ..... H04R 25/453 381/312
2007/0030990 A1 * 2/2007 Fischer ..... H04R 25/407 381/318
2008/0192971 A1 * 8/2008 Tateno ..... H04R 25/43 381/328
2009/0052708 A1 * 2/2009 Munk ..... H04R 25/453 381/318
2010/0150385 A1 * 6/2010 Sporer ..... H04R 25/405 381/313
2010/0254555 A1 * 10/2010 Elmedyb ..... H04R 25/453 381/318

(Continued)

OTHER PUBLICATIONS

International Search Report and the Written Opinion of the International Searching Authority, International Application No. PCT/US2019/014219, pp. 1-14, dated Mar. 18, 2019.

(Continued)

*Primary Examiner* — Suhan Ni
(74) *Attorney, Agent, or Firm* — Bond, Schoeneck & King, PLLC

(57) ABSTRACT

A hearing device configured to be fitted at or in a user's ear canal including an acoustic vent configured to enable sound waves to pass through the hearing device. A directional microphone is configured to create an output signal by amplifying sound traveling in a first direction through the acoustic vent toward the ear canal and attenuating sound traveling in a second direction through the acoustic vent from the ear canal. A receiver is configured to produce sound in response to the output signal. A method of operating a hearing device is also included.

20 Claims, 7 Drawing Sheets

(56) References Cited

U.S. PATENT DOCUMENTS

| | | | | |
|---|---|---|---|---|
| 2012/0140967 | A1* | 6/2012 | Aubert ..... | H04R 25/456<br>381/325 |
| 2015/0063612 | A1 | 3/2015 | Petersen et al. | |

OTHER PUBLICATIONS

International Preliminary Report on Patentability, International Application No. PCT/US2019/014219, pp. 1-9, dated Jul. 28, 2020.

* cited by examiner

NON-OCCLUDING FEEDBACK-RESISTANT HEARING DEVICE

BACKGROUND

The disclosure relates to hearing devices and related devices and methods, and, particularly, to in-the-ear hearing devices having an acoustic vent.

SUMMARY

All examples and features mentioned below can be combined in any technically possible way.

In one aspect, a hearing device configured to be fitted at or in a user's ear canal includes an acoustic vent configured to enable sound waves to pass through the hearing device. A directional microphone is configured to create an output signal by amplifying sound traveling in a first direction through the acoustic vent toward the ear canal and attenuating sound traveling in a second direction through the acoustic vent from the ear canal. A receiver is configured to produce sound in response to the output signal. The sound traveling in the second direction may include sound produced by the receiver. The sound traveling in the second direction may include the user's voice conducted to the ear canal through bone and body tissue. The receiver may include a moving voice coil loudspeaker or a balanced-armature receiver.

Embodiments may include the directional microphone having a microphone array of two or more microphones. The microphones may be microelectromechanical systems (MEMS) microphones. The two or more microphones may be omni-directional microphones. The two or more microphones may be arranged in the acoustic vent. The directional microphone may include electronic circuitry that includes signal processing. The signal processing may include at least one delay element configured to delay a second signal component by a time delay proportional to a physical distance between the two or more microphones divided by the speed of sound. The signal processing may include at least one compensating filter.

Embodiments may include the two or more microphones and the receiver arranged substantially coaxially with respect to each other. The directional microphone may be configured to receive sound as the sound travels through the acoustic vent. The hearing device may include at least one acoustic element covering at least one end of said acoustic vent, wherein said acoustic element has a complex impedance. The hearing device may include at least one acoustic element covering at least one opening of said acoustic vent wherein said acoustic element has a resistive impedance.

In another aspect, a hearing device configured to be fitted at or in a user's ear canal includes an acoustic vent configured to enable sound waves to pass through the hearing device. A directional microphone has at least one microphone in the acoustic vent. The directional microphone is configured to receive first sound waves traveling in a first direction toward the ear canal and convert the first sound waves into a first signal component, receive second sound waves traveling in a second direction from the ear canal and convert the second sound waves into a second signal component, and to create an output signal by amplifying the first signal component and attenuating the second signal component. A receiver is configured to acoustically produce sound in response to the output signal.

In another aspect, a method of operating a hearing device fitted at or in a user's ear canal may include receiving sound traveling in a first direction toward the ear canal with a directional microphone of the hearing device and converting the sound into a first signal component. Sound traveling in a second direction from the ear canal is received with the directional microphone and converted into a second signal component. The first signal component is amplified and the second signal component is attenuated. An output signal is created from the amplified first signal component and the attenuated second signal component. Sound is produced with a receiver of the hearing device in response to the output signal.

Embodiments may include the directional microphone having a first microphone and a second microphone, and sound traveling in the first direction is first received by the first microphone and sound traveling in the second direction is first received by the second microphone. The hearing device may include an acoustic vent and the steps of receiving include receiving the sound as the sound travels through the acoustic vent. The method may include delaying the second signal component by a time delay proportional to a physical distance between the first and second microphones divided by the speed of sound, and wherein the step of creating includes subtracting the second signal component from the first signal component.

DETAILED DESCRIPTION

Figure 1:
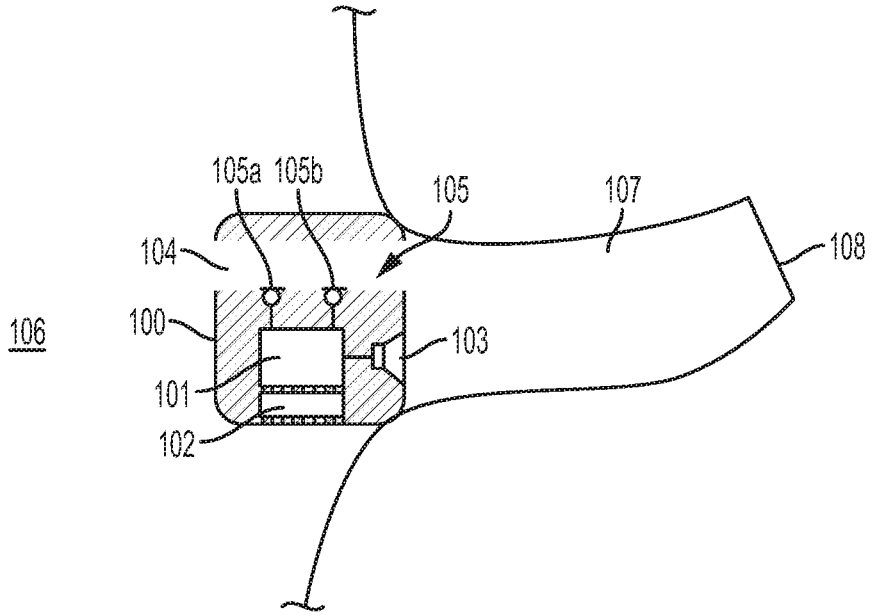
FIG. 1 is a cross-sectional view schematically showing a hearing device according to one embodiment disclosed herein fitted at an entrance of a user's ear cannel.

Hearing devices such as hearing aids and personal sound amplification products, among others, have become increasingly smaller, with many now capable of fitting inside the ear canal. However, drawbacks of fitting hearing devices within or adjacent to the ear canal include the occlusion effect and feedback oscillation. The occlusion effect results from blocking and sealing the ear canal with the hearing device and results in one's own voice sounding loud with over emphasized low frequencies. In some hearing devices, an acoustic vent is added that enables sound to pass unobstructed through the hearing device to reduce the sealing and hence reduce the occlusion effect.

However, as the vent is made larger (e.g., to alleviate the occlusion effect), feedback oscillation becomes more of an issue. Therefore, there is a balance between the gain of the hearing device, the size of the acoustic vent (and hence the amount of occlusion effect), and feedback oscillation. Some hearing devices address the feedback issue by reducing gain at the likely feedback oscillation frequency. While this can reduce or eliminate the occurrence of feedback oscillation, gain in parts of the speech spectrum is often also correspondingly reduced, making the hearing device less effective. In other attempts to eliminate feedback oscillation, adaptive digital signal processing algorithms are used to cancel the transfer function of the feedback path. However, since the feedback path can change, with jaw movement for example, short bursts of oscillation can still occur until the adaptive algorithm catches up and accounts for these changes.

The disclosed hearing device embodiments minimize the occlusion effect due to the inclusion of an acoustic vent. Additionally, low frequency sound waves in the outside environment pass naturally through the acoustic vent into the ear canal and provide the time-difference and level-difference aural cues necessary for sound localization. Sound waves produced by the receiver travel from the ear canal back through the acoustic vent to the outside environment, which can be picked up by the microphone of the hearing device. Thus, to prevent feedback oscillation of the sound produced by the receiver, the hearing devices disclosed herein include a directional microphone. When fitted in a user's ear, the directional microphone is configured to receive sound waves traveling toward the ear canal in a direction of increased sensitivity of the microphone to enable amplification of sounds coming toward the user from the outside environment, while sound waves traveling out of the ear canal (e.g., sound produced by a receiver, the user's own voice conducted through bone and body tissue, etc.) are received by the microphone in a direction of decreased sensitivity of the microphone to suppress feedback oscillation. In other words, the directional microphone enables amplification of sounds from the outside environment while suppressing amplification of sounds traveling outward from the ear canal, including those produced by the receiver, thereby providing a feedback-resistant hearing device.

FIG. 1 shows a hearing device 100 according to one embodiment. The hearing device 100 comprises electronic circuitry 101, a power source 102, a receiver 103, an acoustic vent 104, and a directional microphone 105 in signal communication with the receiver 103. The power source 102 may include a rechargeable or disposable battery. The receiver 103 may be or include any speaker or other components configured to produce sound, including a balanced-armature receiver, a moving voice coil loudspeaker, etc. As discussed in more detail below, the receiver 103 produces sound in response to and/or based on a signal provided by the directional microphone 105. The acoustic vent 104 may be arranged as a tube, channel, passage, groove, or other opening that enables sound to pass through the hearing device 100. The directional microphone 105 may include a least a portion of the electronic circuitry 101, e.g., to enable signal processing, as will be better appreciated in view of the disclosure below.

In the illustrated embodiment, the directional microphone 105 includes a first microphone 105*a* and a second microphone 105*b*. The first and second microphones 105*a* and 105*b* may be or include omni-directional microphones. It is to be appreciated that any type or technology of microphone known or developed in the art may be utilized as the microphones 105*a* and 105*b* and/or to form the directional microphone 105, including microelectromechanical systems (MEMS) microphones, electret microphones, etc. In one embodiment, the microphones 105*a* and 105*b* include two MEMS microphones on the same die for improved matching of the microphones 105*a* and 105*b*.

Regardless of the type of microphone(s) included, the component(s) of the directional microphone 105 configured to receive sound may be located in the acoustic vent 104 and/or configured to receive sound as the sound travels through the acoustic vent 104. For example, in one embodiment the microphones 105*a* and 105*b* are embedded in, recessed in, or protruding from the walls that form the acoustic vent 104. In one embodiment, sound is received by the directional microphone 105 via one or more ports in the walls of the acoustic vent 104 or other housing or structure of the hearing device 100. The directional microphone 105 may include any other number of microphones, including more than two microphones, or even a single microphone. In one embodiment, a single directional microphone is used having a first port arranged in place of the first microphone 105*a* and a second port arranged in place of the second microphone 105*b*, with both of the ports connected to the single microphone, e.g., with each of the ports connected to opposite sides of a diaphragm of the directional microphone.

Referring again to FIG. 1, a two-microphone array (i.e., including the microphones 105*a* and 105*b*) is used to along with signal processing components in the electronic circuitry 101 to form the directional microphone 105. An outside or ambient environment 106 is indicated in FIG. 1, which normally has one or more sound sources that are desired by a user to be amplified by the hearing device 100. FIG. 1 also representatively illustrates an ear canal 107 and a tympanic membrane 108 of a user that receives amplified sound from the hearing device 100 and unamplified sound through the acoustic vent 104 from the outside environment 106.

Figure 2:
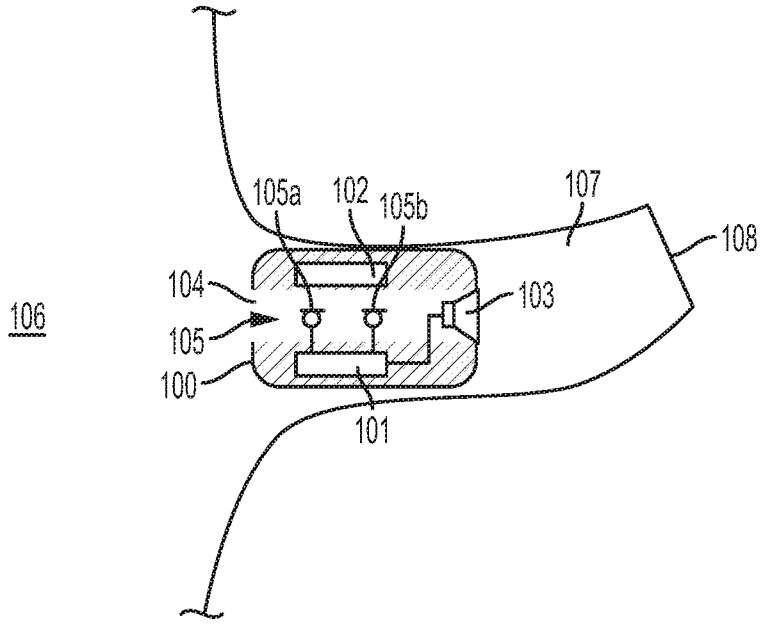
FIG. 2 is a cross-sectional view schematically showing a hearing device according to one embodiment disclosed herein fitted within a user's ear cannel.

While the hearing device 100 in FIG. 1 is shown located at the entrance to the ear canal 107, the hearing device 100 may also be configured for insertion deeper into the ear canal 107 as shown in FIG. 2. As such, the hearing device 100 may be considered or referred to as an in-the-ear hearing device. The receiver 103 may be oriented substantially coaxially with the acoustic vent 104 as shown in FIG. 2, or offset from the acoustic vent 104 as shown in FIG. 1.

Figure 3A:
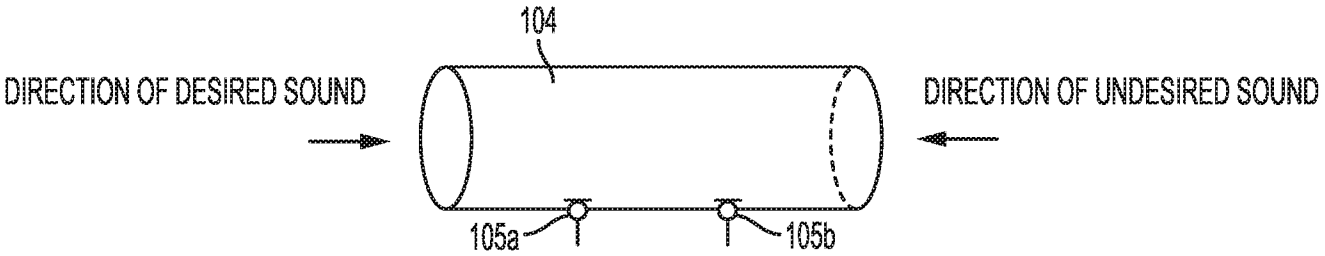
FIG. 3*a* schematically illustrates a directional microphone installed in an acoustic vent showing directions of desired and undesired sound propagation.

FIG. 3*a* shows the acoustic vent 104 in the form of a tube with the two microphones 105*a* and 105*b* located within forming the directional microphone 105. The acoustic vent 104 is located within the hearing device 100 such that sound desired to be amplified enters the acoustic vent 104 closest to microphone 105*a*, and undesired sound (i.e., sound that is not desired to be amplified) enters the acoustic vent 104 at its end closest to microphone 105*b*. The directions of desired and undesired sound are indicated by arrows in FIG. 3*a*.

Figure 3B:
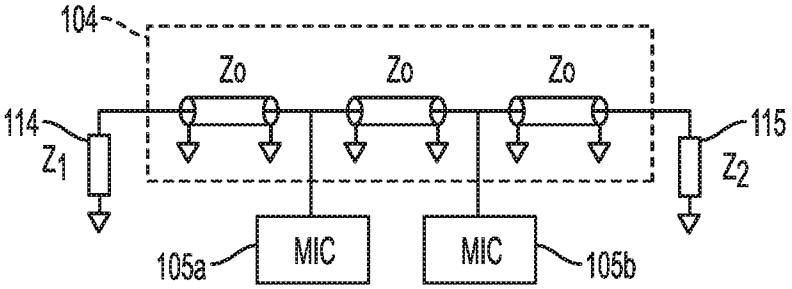
FIG. 3*b* is an equivalent electrical network representing the acoustic network of FIG. 3*a*.

Operation and configuration of the directional microphone 105 can also be appreciated in view of an electrical circuit analogy shown in FIG. 3*b*. The acoustic vent 104 is shown as a three-segment transmission line having a characteristic impedance (Zo) and terminating impedances 114 and 115, having complex impedances Z1 and Z2, respectively. The time delay between the microphones 105*a* and 105*b* depends on the physical spacing between them and the speed of sound and is given by:

$$\Delta t = \frac{d}{c} \quad \text{(Eq. 1)}$$

where d is the distance between microphones (in meters), and c is the speed of sound (in meters/sec), which gives the time delay Δt in seconds. In the equivalent circuit implemented by the electronic circuitry 101, the transmission line between the microphones (105*a* and 105*b*) can then be given a time delay equal to Δt. Likewise, any other transmission lines will be given time delays appropriate for their physical lengths.

Figure 4:
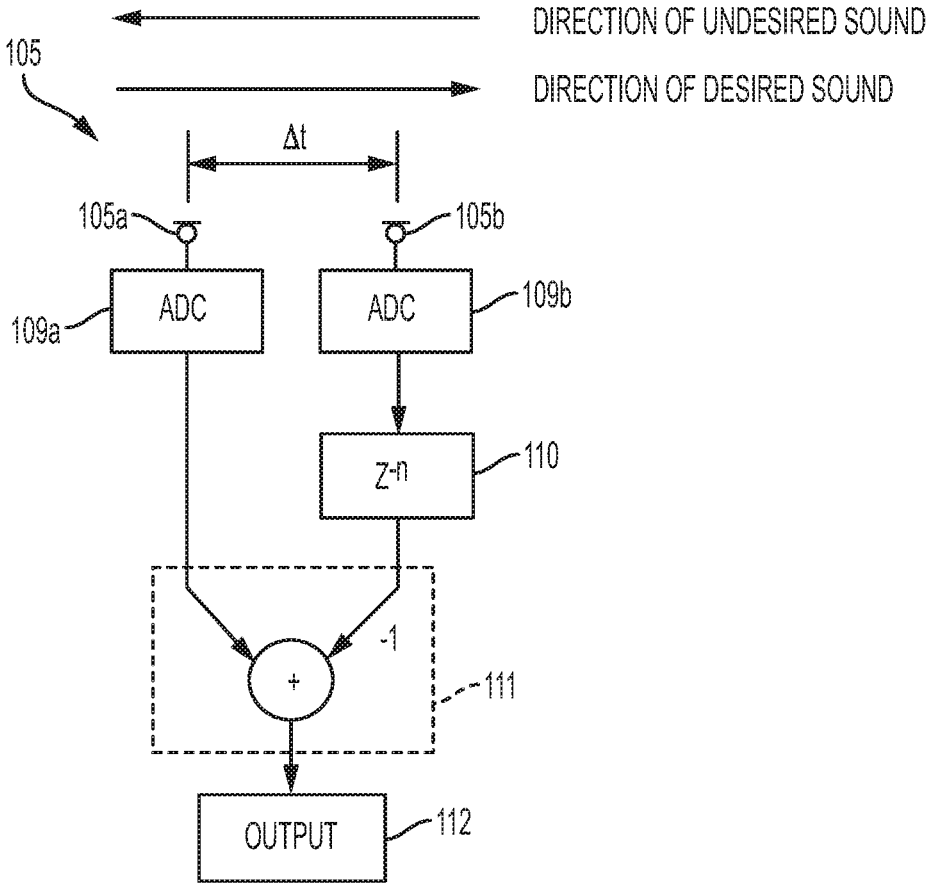
FIG. 4 schematically illustrates signal processing used to create a directional microphone from two microphones according to one embodiment disclosed herein.

To create the directional microphone 105 that will selectively output a signal associated with sound entering the acoustic vent 104 in the desired direction and attenuating the signal associated with sound entering the acoustic vent 104 from the undesired direction, the signal processing algorithm shown in FIG. 4 may be used. In FIG. 4, sound is converted by the microphone 105*a* into a first signal component and by the microphone 105*b* into a second signal component. The signal components from each microphone 105*a* and 105*b* may be converted to digital signals with analog-to-digital converters (ADCs) 109*a* and 109*b*, respectively, if desired. The signal component from the microphone 105*b* is delayed by the amount of time delay (Δt) between the microphones (as determined by equation (1), above) by a delay element 110. The delayed output of ADC 109*b* is subtracted from the un-delayed output of ADC 109*a* in a summation block 111 to form an output signal 112. Since the microphone 105*b* is positioned to receive the undesired sound before it is received by the microphone 105*a* (as determined by the time delay Δt), delay of the second signal component in using the delay element 110 effectively enables the undesired sound to be attenuated from the resulting output signal 112 when the second signal component is subtracted from the first signal component with the summation block 111.

The transfer functions associated with the directional microphone signal processing algorithm of FIG. 4 can be derived. First, the time delay of delay element 110 is set equal to the acoustic time delay between the microphones 105*a* and 105*b* given by equation (1). That is, let:

$$z^{-n}=\Delta t \quad \text{(Eq. 2)}$$

Then the transfer functions F(z) and R(z), respectively for desired sounds from the outside environment 106, or "front", and undesired sounds from the ear canal 107, or "rear", are given by:

$$F(z)=1-z^{-2n} \quad \text{(Eq. 3)}$$

$$R(z)=z^{-n}-z^{-n}=0 \quad \text{(Eq. 4)}$$

The front transfer function F(z) is a high-pass filter, which can be equalized to obtain a flat response. The rear transfer function R(z) evaluates to zero. That is, sounds from the "rear" of the hearing device 100 (i.e., sounds traveling from the ear canal 107 in the undesired direction toward the hearing device 100) are cancelled.

This method of creating a directional microphone (e.g., the directional microphone 105) from omni-directional microphones (e.g., the microphones 105*a* and 105*b*) in advantageous in free-space or in an acoustic transmission line (e.g., tube or vent) terminated in its characteristic impedance at each end because the sound is presented as a progressive plane wave. In practice, terminating impedances 114 and 115 are unlikely to be equal, nor are they likely equal to the characteristic impedance of the acoustic vent 104. Discrepancies between the terminating impedances and the characteristic impedance will introduce reflections at the ends of the acoustic vent 104 resulting in non-uniform frequency responses at the positions of the two microphones 105*a* and 105*b*. If left unresolved, this may negatively affect the directional microphone performance described by equations (3) and (4).

Figure 5:
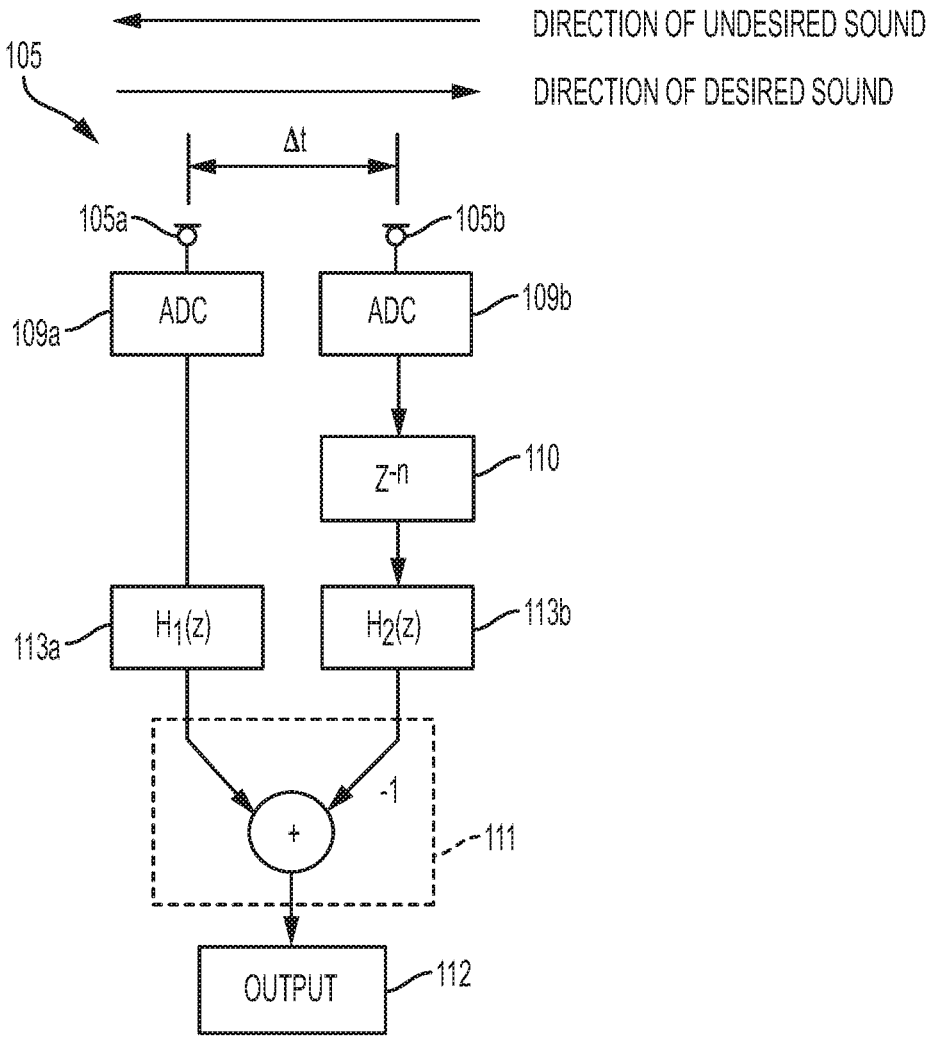
FIG. 5 is schematically illustrates signal processing used to create a directional microphone from two microphones according to one embodiment disclosed herein, particularly for unmatched acoustical terminations.

In one embodiment, compensating filters 113*a* and 113*b* are included by the directional microphone 105 (e.g., implemented by the electronic circuitry 101) as shown in FIG. 5 to compensate for the effects of the reflections noted above. If the filters 113*a* and 113*b* have transfer functions $H_1(z)$ and $H_2(z)$, respectively, the front and rear transfer functions then become:

$$F(z)=M_1(z)H_1(z)-M_2(z)H_2(z)z^{-2n}. \quad \text{(Eq. 5)}$$

$$R(z)=[M_1(z)H_1(z)-M_2(z)H_2(z)]z^{-n} \quad \text{(Eq. 6)}$$

where $M_1(z)$ and $M_2(z)$ are the equivalent discrete-time transfer functions at the positions of the associated microphones (e.g., the microphones 105*a* and 105*b*) due to the reflections from the ends of the acoustic vent 104. The transfer functions $M_1(z)$ and $M_2(z)$ are defined by the acoustic network. The transfer functions $H_1(z)$ and $H_2(z)$ can be selected to minimize R(z). For example, when $H_1(z)$ and $H_2(z)$ are selected such that $M_1(z)H_1(z)=M_2(z)H_2(z)=1$, then equations (5) and (6) revert to equations (3) and (4). However, it is to be appreciated that the directional microphone 105 reduces feedback oscillation as long as the magnitude of R(z) is less than the magnitude of F(z), with generally improved performance as R(z) is reduced further. Additionally, it is to be appreciated that while FIG. 5 shows two compensating filters (113*a* and 113*b*), either one of these filters may be removed without unduly compromising performance by adjusting the transfer function of the remaining filter appropriately.

It is to be appreciated that the output signal 112 may undergo additional signal processing if desired. For example, the hearing device 100 may include any desired components and/or signal processing means known or discovered in the field of hearing aid design, which includes but is not limited to amplification, filtering (e.g., frequency response equalization), compression, etc.

Figure 6A:
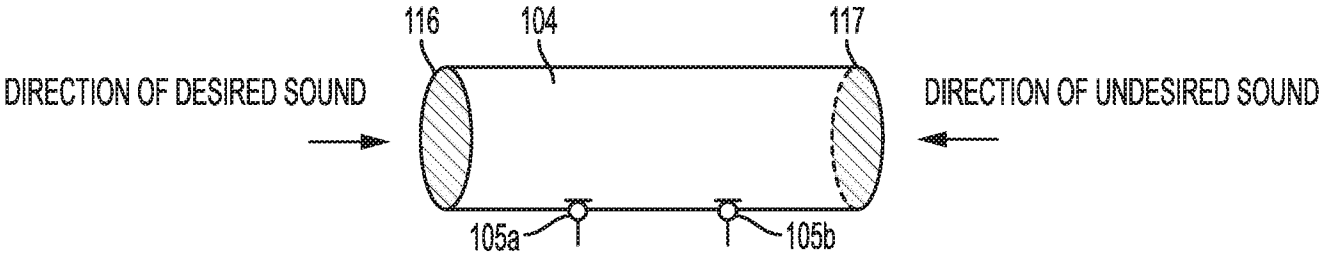
FIG. 6*a* schematically illustrates two microphones installed in an acoustic vent having an acoustic element at each opening.
Figure 6B:
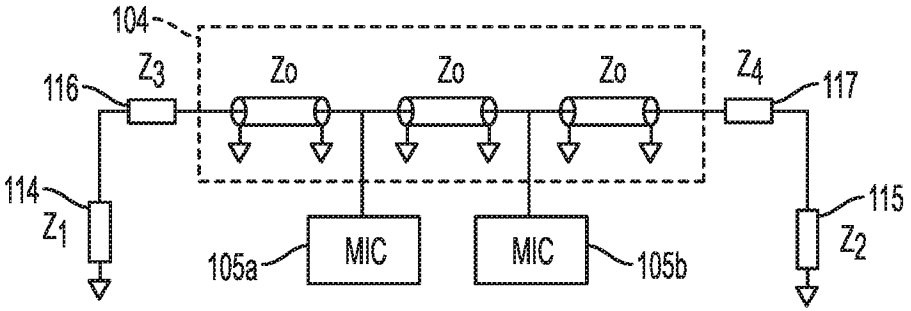
FIG. 6*b* is an equivalent electrical network representing the acoustic network of FIG. 6*a*.

One embodiment is shown in FIG. 6*a* in which one or more acoustic elements are included at one or both ends of the acoustic vent 104 to set or change the acoustical properties of the acoustic vent 104. In the embodiment of FIG. 6, acoustic elements 116 and 117 are added at each end of the acoustic vent 104. The acoustic elements could include pieces of cloth, mesh, or any other material that provides a desired complex impedance. That is, the acoustic elements 116 and 117 can be selected so that they have a complex impedance that in combination with terminating impedances 114 and 115, respectively, provides an improved match to the characteristic impedance of the acoustic vent 104 when compared to only the terminating impedances 114 and 115. The improved impedance match reduces the acoustic reflections at the ends of the acoustic vent 104 which in turn improves the performance of the directional microphone 105 formed by microphones 105*a* and 105*b*. In another embodiment, at least one of the acoustic elements 116 and 117 is substantially resistive.

Figure 7:
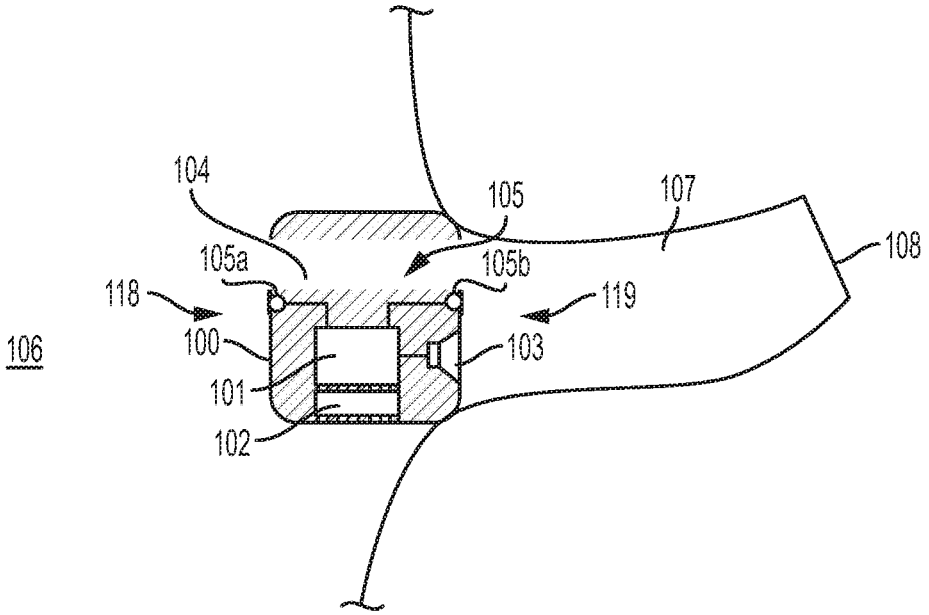
FIG. 7 is a cross-sectional view schematically showing a hearing device according to one embodiment disclosed herein having a directional microphone formed by two microphones located at opposite faces of the hearing device.

The hearing device 100 according to one embodiment is illustrated in FIG. 7. With respect to the embodiment of FIG.

7, it can be appreciated that one or both of the microphones 105*a* or 105*b* can be positioned outside of the acoustic vent 104. That is, since sound entering the acoustic vent 104 from the outside environment 106 (i.e., desired sound) will also hit an outer or front face 118 of the hearing device 100, the microphone 105*a* may in be positioned at the face 118. Similarly, since sound entering the acoustic vent 104 from within the ear canal 107 (i.e., undesired sound) will also hit an inner or rear face 119 of the hearing device 100 (opposite to the outer face 118), the microphone 105*b* may be positioned at the face 119. If the directional microphone 105 is formed from a single microphone, then the faces 118 and 119 may include first and second ports, respectively, which feed to the single microphone as noted above.

Figure 8:
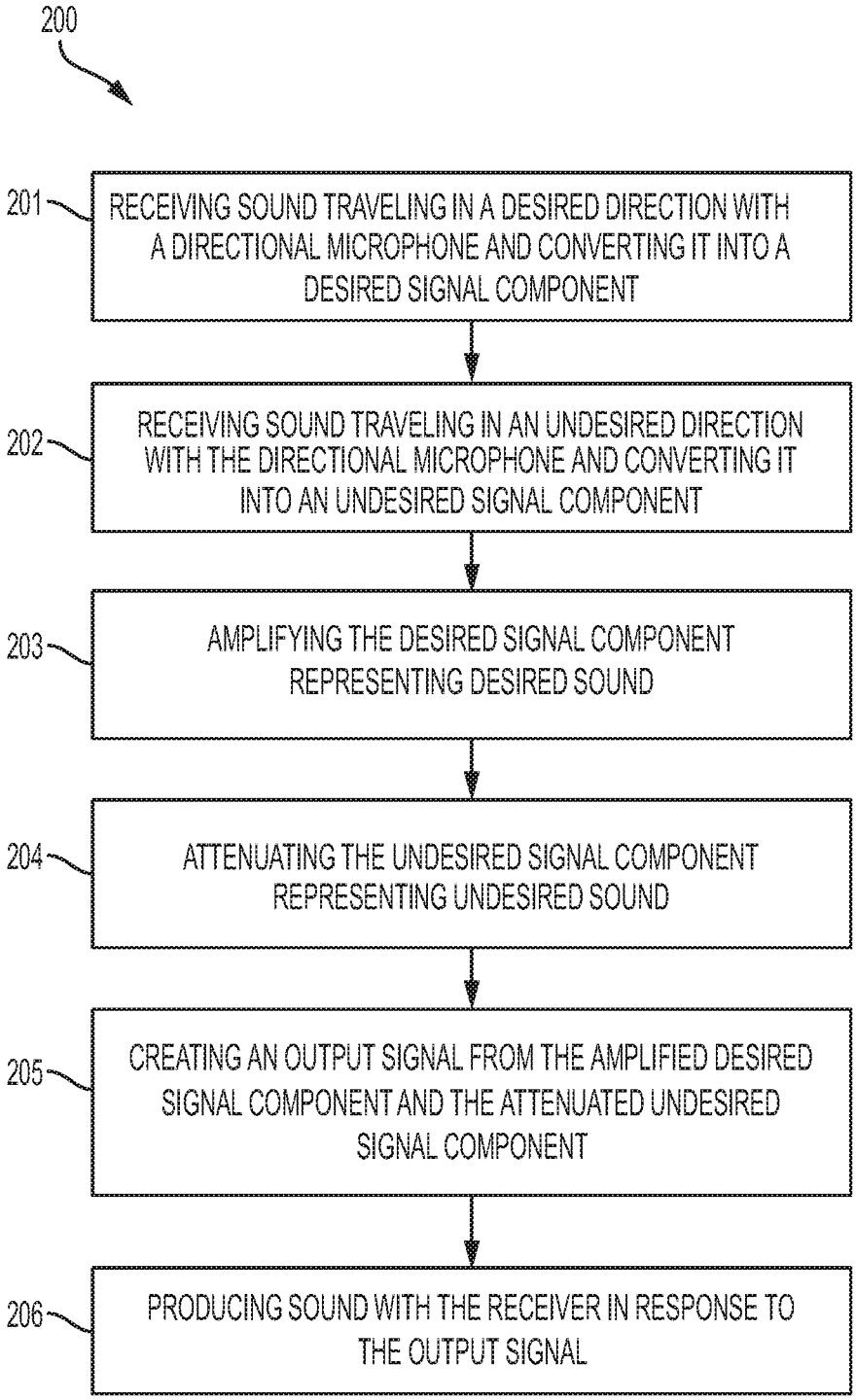
FIG. 8 is a flowchart of a method of operating a feedback-resistant hearing device according to one embodiment disclosed herein.

While methods of operating the hearing device 100 can be appreciated in view of the above disclosure, a method 200 is provided as a flowchart in FIG. 8. At a step 201, sound is received traveling in a desired direction by a directional microphone (e.g., the directional microphone 105) converted to create a desired signal component. At a step 202, sound is received traveling in an undesired direction by the directional microphone and converted to create an undesired signal component. It is to be appreciated that if a two (or more) microphone array is utilized for the directional microphone (e.g., the microphones 105*a* and 105*b*), both microphones are likely to receive both the undesired and the desired sound (separated by the time delay $\Delta t$). Thus, the designations "undesired signal component" and "desired signal component" refer to the sound that is first received by each microphone and how the resulting signal components are used during creation of the output signal (e.g., by delaying the "undesired" signal component and subtracting it from the "desired" signal component in order to attenuate the undesired sound, as discussed above).

At a step 203, the desired signal component is amplified (e.g., using the electronic circuitry 101 and/or signal processing of FIG. 4 or 5). At a step 204, the undesired signal component is attenuated. At a step 205, an output signal is created from the amplified desired signal component and the attenuated undesired signal component. At a step 206, a receiver of the hearing device (e.g., the receiver 103) produces sound in response to the output signal. It is noted that the steps are not necessary presented in chronological order and that some steps may occur concurrently. For example, the step 203 may occur after the step 204 or after the step 205. That is, after attenuating the undesired signal component, the two signal components could be combined in the step 205 to create the output signal, and then the output signal could be amplified. Since the undesired signal component has already been attenuated, the output signal is primary formed from the desired signal component, and therefore amplifying the output signal effectively amplifies the desired signal component as required by the step 203.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

The invention claimed is:

1. A hearing device configured to be fitted at or in a user's ear canal, comprising:

an acoustic vent configured to enable sound to pass through the hearing device;

a directional microphone configured within the acoustic vent to create an output signal which both 1) amplifies sound from an outside environment traveling in a first direction through the acoustic vent toward the ear canal and 2) attenuates sound traveling in an opposite direction to the first direction through the acoustic vent from the ear canal; and a receiver configured to produce sound in response to the output signal, wherein the receiver is secured to an inward wall of the hearing device, and further wherein the inward wall is arranged to face a tympanic membrane of the user.

2. The hearing device of claim 1, wherein sound traveling in the opposite direction includes sound produced by the receiver, the user's voice conducted to the ear canal through bone and body tissue, or a combination including at least one of the foregoing.

3. The hearing device of claim 1, wherein the receiver includes a moving voice coil loudspeaker or a balanced-armature receiver.

4. The hearing device of claim 1, wherein the directional microphone comprises a microphone array of two or more microphones configured within the acoustic vent, and wherein an outer face of the hearing device does not include a microphone.

5. The hearing device of claim 4, in which the microphones are MEMS microphones.

6. The hearing device of claim 4, wherein the two or more microphones are omni-directional microphones.

7. The hearing device of claim 4, wherein the two or more microphones are arranged in the acoustic vent.

8. The hearing device of claim 4, wherein the directional microphone comprises electronic circuitry that includes signal processing.

9. The hearing device of claim 8, wherein the signal processing comprises at least one delay element configured to delay sound received by one of the two or more microphones closest to the ear canal by a time delay proportional to a physical distance between the two or more microphones.

10. The hearing device of claim 8, wherein the signal processing comprises at least one compensating filter.

11. The hearing device of claim 4, wherein the two or more microphones and the receiver are arranged substantially coaxially with respect to each other.

12. The hearing device of claim 1, wherein the directional microphone is configured to receive sound as the sound travels through the acoustic vent.

13. The hearing device of claim 1, further comprising at least one acoustic element covering at least one end of said acoustic vent, wherein said acoustic element has a complex impedance or a resistive impedance.

14. A hearing device configured to be fitted at or in a user's ear canal, comprising:

an acoustic vent configured to enable sound waves to pass through the hearing device;

a directional microphone configured within the acoustic vent in the acoustic vent, the directional microphone configured to both 1) receive first sound waves from an outside environment traveling in a first direction toward the ear canal and convert the first sound waves into a first signal component and 2) receive second sound waves traveling in an opposite direction to the first direction from the ear canal and convert the second sound waves into a second signal component, and further configured to create an output signal by amplifying the first signal component and attenuating the second signal component; and a receiver configured to produce sound in response to the output signal, wherein the receiver is secured to an inward wall of the hearing device, and further wherein the inward wall is arranged to face a tympanic membrane of the user.

15. The hearing device of claim 14, wherein the directional microphone comprises two microphones configured within the acoustic vent and electronic circuitry that includes signal processing to create the output signal, and wherein an outer face of the hearing device does not include a microphone.

16. The hearing device of claim 15, wherein the signal processing comprises at least one delay element configured to delay sound received by one of the two microphones that is located closest to the ear canal by a time delay proportional to a physical distance between the two microphones, and a summation block configured to subtract the second signal component from the first signal component after being delayed by the at least one delay element.

17. A method of operating a hearing device fitted at or in a user's ear canal, comprising:

receiving sound from an outside environment traveling in a first direction toward the ear canal by a directional microphone configured within the acoustic vent of the hearing device and converting the sound into a first signal component;

receiving sound traveling in an opposite direction to the first direction from the ear canal by said directional microphone configured within the acoustic vent of the hearing device and converting the sound into a second signal component;

amplifying the first signal component;

attenuating the second signal component;

creating an output signal from the amplified first signal component and the attenuated second signal component; and producing sound with a receiver of the hearing device in response to the output signal, wherein the receiver is secured to an inward wall of the hearing device, and further wherein the inward wall is arranged to face a tympanic membrane of the user.

18. The method of claim 17, wherein the hearing device includes an acoustic vent and the steps of receiving include receiving the sound as the sound travels through the acoustic vent.

19. The method of claim 17, wherein the directional microphone includes a first microphone and a second microphone, and sound traveling in the first direction is first received by the first microphone to create the first signal component and sound traveling in the second direction is first received by the second microphone to create the second signal component.

20. The method of claim 19, further comprising delaying the second signal component by a time delay proportional to a physical distance between the first and second microphones, and wherein the step of creating includes subtracting the second signal component from the first signal component.

* * * * *